United States Patent [19]

Eisenlohr

[11] Patent Number: 4,485,848

[45] Date of Patent: Dec. 4, 1984

[54] TERRY WEAVING MACHINE HAVING A DEFLECTING MECHANISM FOR WARP YARNS

[75] Inventor: Franz Eisenlohr, Tuttwil, Switzerland

[73] Assignee: Sulzer Brothers, Ltd., Winterthur, Switzerland

[21] Appl. No.: 450,437

[22] Filed: Dec. 16, 1982

[30] Foreign Application Priority Data

Jan. 13, 1982 [EP] European Pat. Off. ..... 82 810010.7

[51] Int. Cl.[3] ..... D03D 39/22

[52] U.S. Cl. ..... 139/25; 139/116; 139/434

[58] Field of Search ..... 139/116, 25, 26, 27, 139/429, 434, 292, 194

[56] References Cited

U.S. PATENT DOCUMENTS

| | | | |
|---|---|---|---|
| 1,827,646 | 10/1931 | Gabler | 139/116 |
| 3,115,902 | 12/1963 | Dewas | 139/434 |
| 3,724,509 | 4/1973 | Burgess et al. | 139/25 |

*Primary Examiner*—Henry S. Jaudon

*Attorney, Agent, or Firm*—Kenyon & Kenyon

[57] ABSTRACT

The terry weaving machine is provided with a deflecting mechanism for guiding the edge warp yarns therethrough to retain the tucked-in end of a weft yarn in tong-like fashion. The deflecting mechanism may be in the form of a plate with a single slot or may be defined by a pair of adjustable jaws so that the slot can be sized depending upon the size and type of yarns being woven.

10 Claims, 4 Drawing Figures

TERRY WEAVING MACHINE HAVING A DEFLECTING MECHANISM FOR WARP YARNS

This invention relates to a terry weaving machine having a deflecting mechanism for warp yarns.

As is known, terry weaving machines are constructed so as to impart a loop to warp yarns via weft yarns which are beaten up at a beating-up station to form a cloth. These machines generally have a reed for beating-up a weft yarn delivered into a shed of warp yarns at a beating-up station as well as a temple and breast beam which are located down-stream of the reed for guiding the woven cloth. In machines of this kind, loop formation proceeds according to the principle of fabric control. That is, the reed moves in a conventional manner but the cloth or fabric is periodically moved away from beating-up station by a common movement of the breast beam and temple. Usually, two or three partial beating-ups are carried out after each complete beating-up for a subsequent looping of the pile warp (three-weft or four-weft terry material).

For fabrics which are woven in a normal fashion, a tucked-in selvage is usually effected, for example as described in U.S. Pat. No. 3,457,966. In these cases, the weft yarn ends which project at the edge of the cloth are retained in an extended position until the completion of picking. Thereafter, the weft yarn ends are tucked into the next shed and beaten-up together with the next weft yarn. Consequently, the tucked-in end of each weft yarn is prevented from sliding out by the changing of the shed in the formation of the following shed.

However, in the case of terry cloth, the securing of the tucked-in end has been uncertain for some yarns or selvage textures. This is because the shed of the edge yarns remains open during the partial beating-ups. As a result, all or some of the tucked-in ends may unnecessarily project in some cases during loop formation.

Accordingly, it is an object of the invention to maintain a tucked-in end of a weft yarn in place during loop formation for terry cloth.

It is another object of the invention to eliminate the projection of a tucked-in end of a weft yarn during terry weaving.

It is another object of the invention to provide a terry cloth with a satisfactory tucked-in edge for all yarns or selvage textures.

It is another object of the invention to provide an attachment for a terry weaving machine which can be easily installed to effect a clean selvage.

Briefly, the invention provides a stationary means, such as a deflecting mechanism, for narrowing a shed produced in a terry weaving machine at at least one edge in order to maintain a tucked-in end of a weft yarn in the shed. The deflecting mechanism is attached to the terry weaving machine between a means, such as a reed, for beating-up a weft yarn at a beating-up station and a movable temple and breast beam arrangement for guiding a cloth from the beating-up station. The deflecting mechanism serves to narrow the edge warp yarns in the top shed and/or bottom shed positions.

The deflecting mechanism is such that the edge warp yarns are pressed in a tongs-like fashion against the tucked-in end of a weft yarn so that the weft yarn end is retained between the edge warp yarns even when the cloth is moved away from the beating-up station or zones. The result is a clean tucked-in selvage without projecting ends or loops.

In one embodiment, the deflecting mechanism is in the form of a guide plate having a slot for guiding at least two warp yarns therethrough at the edge of the shed. This embodiment permits the deflecting mechanism to be manufactured in a simple manner.

In another embodiment, the deflecting mechanism includes a pair of adjustable jaws which define a slot for guiding at least two warp yarns at the edge of the shed. This embodiment provides the advantage that the deflecting mechanism can be adapted to different yarn thicknesses and different types of fabric. In addition, the deflecting mechanism may include a scale for indicating the size of the slot between the jaws. This scale can be formed in the fashion of a sliding caliper. This enables the slot to be adjusted in measurable or reproducable manner.

These and other objects and advantages of the invention will become more apparent from the following detailed description taken in conjunction with the accompanying drawings wherein:

FIG. 1 diagramatically illustrates a terry weaving machine constructed in accordance with the invention;

Figure 1:
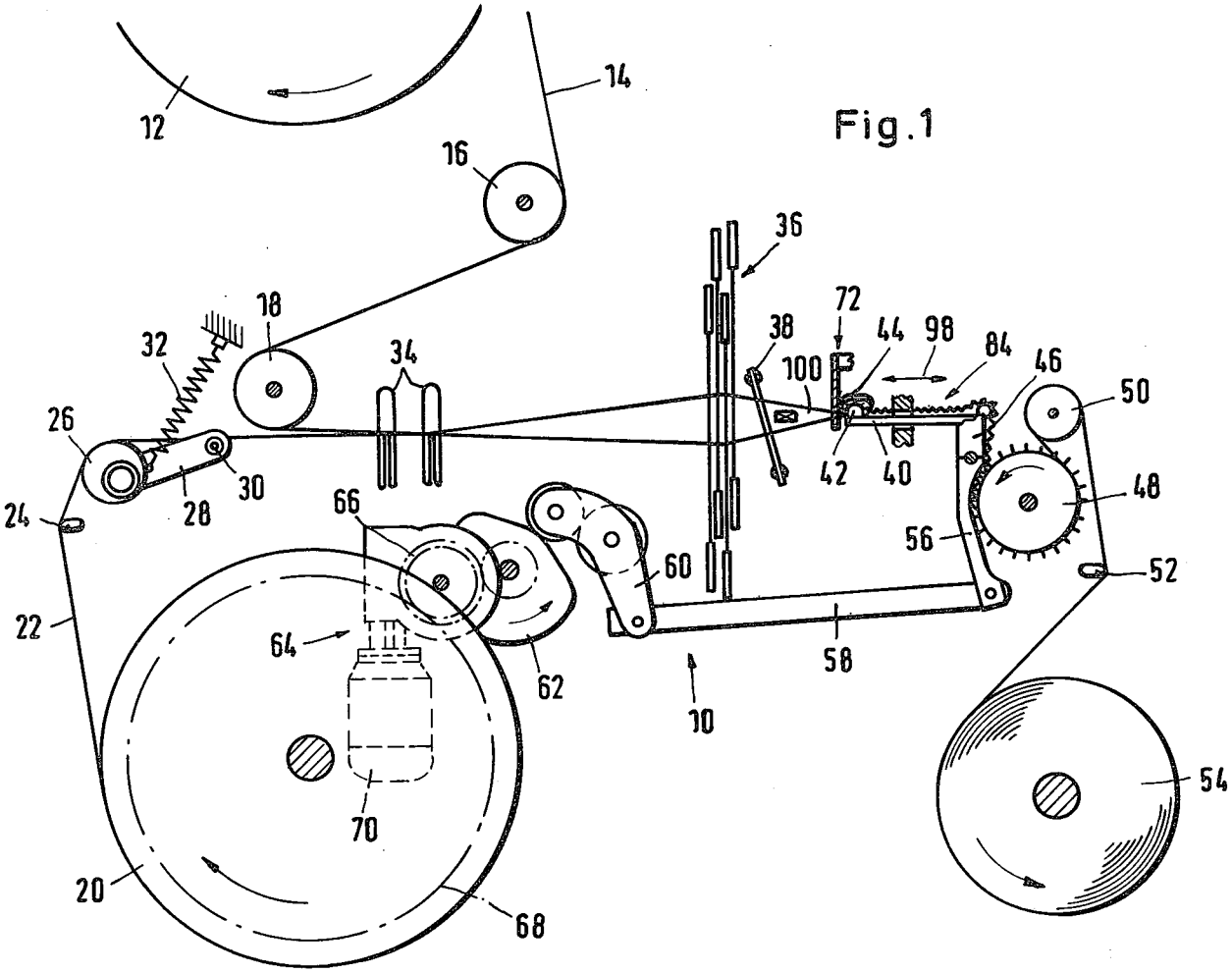

Referring to FIG. 1, the terry weaving machine is of generally conventional structure. For example, the weaving machine 10 has a ground warp beam 12 from which a plurality of ground warps 14 extend via a deflecting beam 16 to a whip roll 18 as well as a pile warp beam 20 from which a plurality of pile warps 22 extend via a temple 24 and a resiliently mounted whip roll 26 which is secured to a lever pair 28. As indicated, the lever pair 28 is pivotally mounted about a pivot 30 and is biased by a spring 32 against the pile warps 22.

In addition, the ground warps 14 and pile warps 22 are guided via warp yarn detectors 34 into a means for forming a shed. This means includes a plurality of heddles 36 which are able to shift the warps into a top shed position and/or a bottom shed position. In addition, a means is provided in the form of a reed 38 for beating up a weft yarn within the shed to a beating-up station to form a cloth or fabric.

The machine 10 also has a slide 40 comprised of a temple 44 having a needle roller 42 and a breast beam 46 over which the cloth is guided away from the beating-up station. In addition, a needled stepping beam 48, a pressing beam 50, and a temple 52 are provided to guide the cloth onto a cloth beam 54.

As indicated, a means is provided for periodically reciprocating the temple 44 and breast beam 46 to effect a terry weave in the cloth. This means includes a pull link 56 which is connected to the breast beam 46, a pull hook or lever 58 and a cam follower lever 60 which connect the breast beam 46 to a terry cam 62. This cam 62 meshes with a worm drive 66 forming part of a warp beam drive 64. The worm drive 66 also meshes with a toothed annulus 68 of the warp beam 20. In addition, a drive motor 70 is provided for driving the warp beam drive 64.

Figure 2:
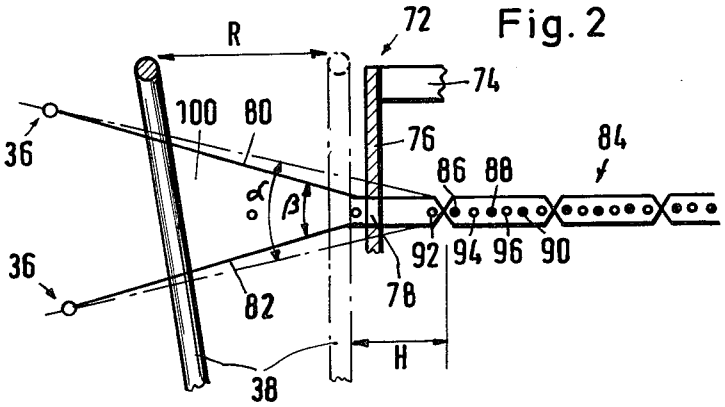
FIG. 2 illustrates a side view of a deflecting mechanism used in the machine of FIG. 1.

Referring to FIGS. 1 and 2, a means in the form of a stationary deflecting mechanism 72 is disposed between the reed 38 and temple 44 for narrowing the shed on opposite sides, i.e., from the top and from the bottom, as viewed at least on one edge in order to maintain a tucked-in end of a weft yarn in the shed.

Figure 3:
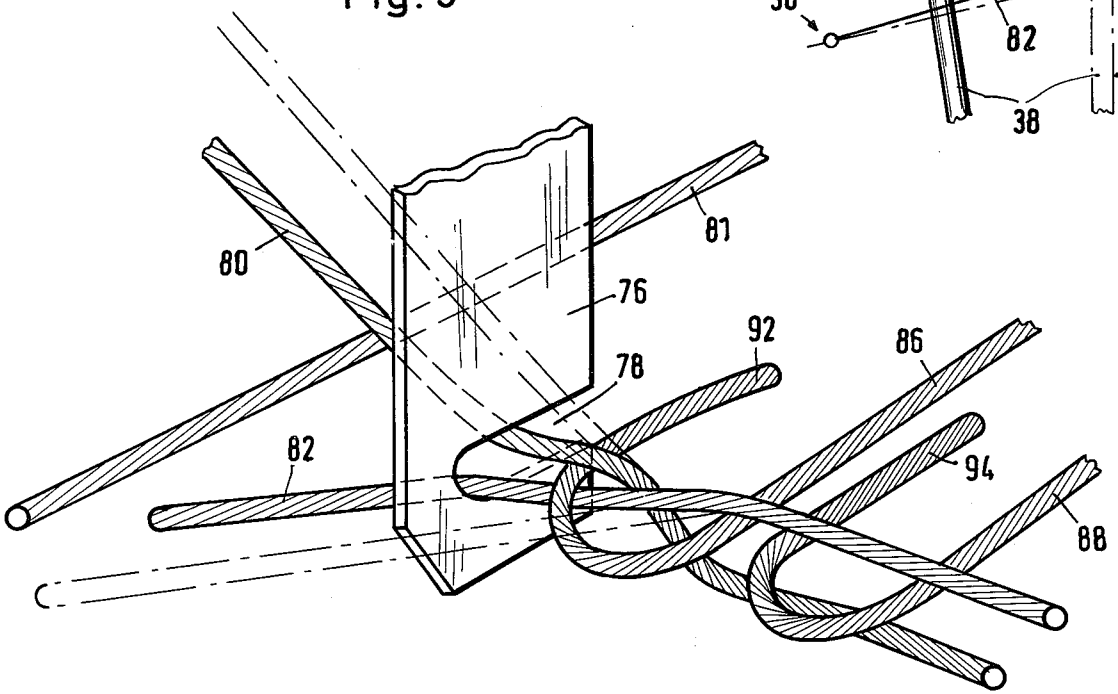
FIG. 3 illustrates an enlarged perspective view of a part of the deflecting mechanism of FIG. 2.

Referring to FIGS. 2 and 3, the deflecting mechanism 72 includes a guide plate 76 which is secured to a mounting 74 of the machine 10 and which is formed with a slot 78 for guiding at least two warp yarns 80, 82 therethrough in the top and/or bottom shed position at the edge of the shed. In FIG. 2, the weft yarns of the cloth 84 are shown as solid circles 86, 88, 90 whereas their corresponding tucked-in ends are shown as open circles 92, 94, 96. In addition, the fabric has a lift H as indicated.

During operation of the weaving machine 10, the terry cam 62 (FIG. 1) acts via the lever 60, hook 58 and link 56 to reciprocate the slide 40 in the direction indicated by the double arrow 98. The cloth 84 thus makes an operative movement (lift) H relative to the beating-up position (shown in chain dotted lines in FIG. 2) of the reed 38. As indicated in FIG. 2, the reed 38 has an operative movement R. As also indicated in FIG. 2, in each operative movement H, the slot 78 of the plate 72 narrows the shed 100. The angle $\alpha$ between the edge warp yarns, 80, 82 at the beginning of the operative movement (position shown in chain-dotted lines) increases to the value $\beta$ at the termination of the operative movement. As indicated in greater detail in FIG. 3, the tucked-in end 92 of the weft yarn 86 is engaged in tong-like fashion between the edge warp yarns 80, 82. Thus, the tucked-in end 92 is reliably retained during the return movement of the cloth with a corresponding looping of the warp yarns. The next weft yarn 81 to be beaten-up by the reed 38 can then be inserted into the shed 100.

Figure 4:
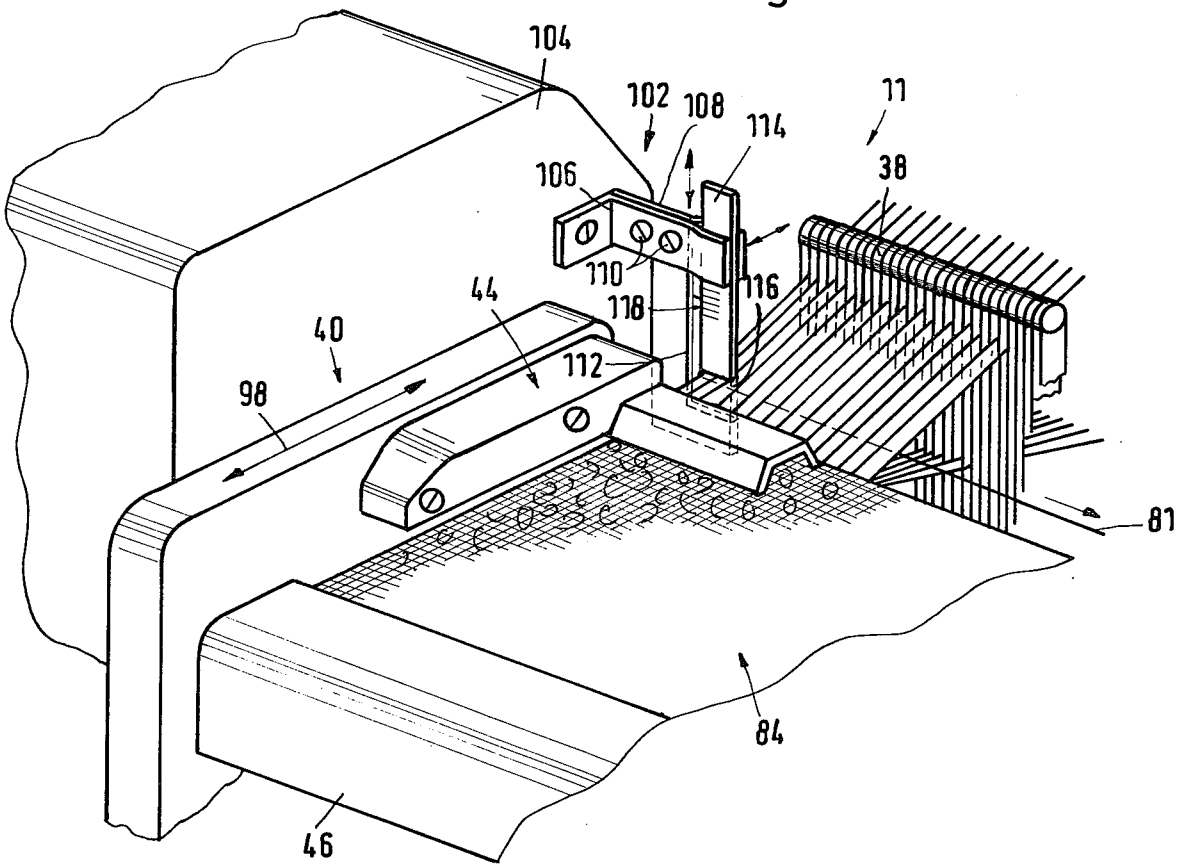
FIG. 4 illustrates a perspective view of a further embodiment of a deflecting mechanism according to the invention.

Referring to FIG. 4, wherein like reference characters indicate like parts as above, the deflecting mechanism 102 may include an angle bracket 106 which is secured to a stationary upright 104 of the machine 10 and to which a clamping plate 108 serves to hold an angle plate 112 and an associated plate 114 therebetween. The two plates 112, 114 are movable relative to one another in the manner of adjustable jaws or calibers in order to define a slot 116 therebetween. This facilitates rapid adjustment of the slot 116 to adapt to different yarn thicknesses or different kinds of fabrics. In addition, the deflecting mechanism 102 includes a scale 118 for indicating the size of the slot 116 between the plates 112, 114. This scale 118 resembles a sliding caliber and insures a measurable or reproducable adjustment of the slot 116.

The invention thus provides a means for insuring the retention of a tucked-in weft yarn end during a terry weaving operation. In addition, the invention provides a means which can be constructed of relatively simple parts and which can be readily attached to existing terry weaving machines.

What is claimed is:

1. A terry weaving machine comprising a reed for beating-up a weft yarn disposed within a shed of warp yarns at a beating-up station into a woven cloth;

a movable temple downstream of said reed for guiding the cloth from said beating-up station;

a movable breast beam downstream of said reed for guiding the cloth thereon; and a stationary deflecting mechanism between said reed and said temple for narrowing the shed on opposite sides at least on one edge thereof to maintain a tucked-in end of a weft yarn in the shed.

2. A terry weaving machine as set forth in claim 1 wherein said deflecting mechanism includes a guide plate having a slot for guiding at least two warp yarns therethrough at said edge of the shed.

3. A terry weaving machine as set forth in claim 1 wherein said deflecting mechanism includes a pair of adjustable jaws defining a slot for guiding at least two warp yarns therethrough at said edge of the shed.

4. A terry weaving machine as set forth in claim 3 wherein said deflecting mechanism includes a scale for indicating the size of the slot between said jaws.

5. In a terry weaving machine, the combination comprising means for beating-up weft yarn disposed within a shed of warp yarns at a beating-up station into a cloth; and a stationary deflection mechanism for narrowing the shed from the top and from the bottom at least on one edge thereof to maintain a tucked-in end of a weft yarn in the shed.

6. The combination as set forth in claim 5 wherein said deflecting mechanism includes a guide plate having a slot for guiding at least two warp yarns therethrough at said edge of the shed.

7. The combination as set forth in claim 5 wherein said deflecting mechanism includes a pair of adjustable jaws defining a slot for guiding at least two warp yarns therethrough at said edge of the shed.

8. In a terry weaving machine, the combination comprising means for forming a shed of warp yarns;

means for beating-up a weft yarn disposed within the shed at a beating-up station into a cloth;

a temple downstream of said reed for guiding the cloth from said beating up station;

a breast beam downstream of said temple for guiding the cloth thereon;

means for periodically reciprocating said temple and said breast beam to effect a terry weave in the cloth; and stationary means for narrowing the shed from the top and from the bottom at least on one edge thereof to maintain a tucked-in end of a weft yarn in the shed.

9. The combination as set forth in claim 8 wherein said means for narrowing the shed includes a guide plate having a slot for guiding at least two warp yarns therethrough at said edge of the shed.

10. The combination as set forth in claim 8 wherein said means for narrowing the shed includes a pair of adjustable jaws defining a slot for guiding at least two warp yarns therethrough at said edge of the shed.

* * * * *